US009564706B2

(12) United States Patent
Ozawa et al.

(10) Patent No.: US 9,564,706 B2
(45) Date of Patent: Feb. 7, 2017

(54) CONNECTION UNIT

(71) Applicants: HONDA MOTOR CO., LTD., Tokyo (JP); SUMITOMO WIRING SYSTEMS, LTD., Mie (JP)

(72) Inventors: Hiroyuki Ozawa, Saitama (JP); Akinari Hayashi, Saitama (JP); Takehiro Endo, Saitama (JP); Akihiko Takemura, Mie (JP)

(73) Assignees: HONDA MOTOR CO., LTD., Tokyo (JP); SUMITOMO WIRING SYSTEMS, LTD., Yokkaichi (JP)

( * ) Notice: Subject to any disclaimer, the term of this patent is extended or adjusted under 35 U.S.C. 154(b) by 0 days.

(21) Appl. No.: 14/297,751

(22) Filed: Jun. 6, 2014

(65) Prior Publication Data

US 2014/0364016 A1 Dec. 11, 2014

(30) Foreign Application Priority Data

Jun. 7, 2013 (JP) ..... 2013-120480

(51) Int. Cl.

| | |
|---|---|
| ***H01R 4/34*** | (2006.01) |
| ***H01R 13/52*** | (2006.01) |
| ***H01R 4/30*** | (2006.01) |
| *H01R 105/00* | (2006.01) |
| *H01R 13/405* | (2006.01) |

(52) U.S. Cl.

CPC ..... *H01R 13/521* (2013.01); *H01R 4/301* (2013.01); *H01R 13/405* (2013.01); *H01R 2105/00* (2013.01)

(58) Field of Classification Search

CPC ..... H01R 13/521; H01R 4/301; H01R 9/22; H01R 9/223; H01R 9/226; H01R 4/34; H01R 4/302; H01R 4/30; H01R 4/307

USPC ..... 439/737

See application file for complete search history.

(56) References Cited

U.S. PATENT DOCUMENTS

| | | | | |
|---|---|---|---|---|
| 4,929,198 | A * | 5/1990 | Strate et al. | 439/709 |
| 7,722,372 | B2 * | 5/2010 | Matsumoto | H01R 13/42 174/68.2 |
| 7,811,116 | B2 * | 10/2010 | Sakakura et al. | 439/364 |
| 8,460,039 | B2 * | 6/2013 | Akuta | 439/722 |

(Continued)

FOREIGN PATENT DOCUMENTS

JP 2011-108411 A 6/2011

*Primary Examiner* — Amy Cohen Johnson
*Assistant Examiner* — Matthew T Dzierzynski
(74) *Attorney, Agent, or Firm* — Westerman, Hattori, Daniels & Adrian, LLP

(57) ABSTRACT

The present invention provides a connection unit capable of accommodating nuts and showing sealing ability in a state installed on a housing.

A connection unit S includes: a terminal block 100 having holes h3 at one side of for accommodating nuts n; a terminal-connecting portions 200 at least partially exposed when viewed from the other side and fixed to the terminal block 100 with the circumferences of the terminal-connecting portions 200 in tight contact with the terminal block 100; and a nut cover 300 for covering the nuts accommodated in the holes h3 for preventing the nuts n from coming off. The connection unit S further includes: guide grooves and guide ribs for restricting movement of the nut cover 300 relative to the terminal block 100; and locking hooks 116 and locking holes h5 for restricting movement of the nut cover 300 relative to the terminal block 100.

7 Claims, 6 Drawing Sheets

(56) References Cited

U.S. PATENT DOCUMENTS

| | | | | |
|---|---|---|---|---|
| 8,608,518 | B2 * | 12/2013 | Wu | 439/812 |
| 8,636,550 | B2 * | 1/2014 | Onoda et al. | 439/766 |
| 8,662,920 | B2 * | 3/2014 | Ishibashi et al. | 439/564 |
| 2002/0132522 | A1 * | 9/2002 | Miyazaki et al. | 439/559 |
| 2011/0117792 | A1 * | 5/2011 | Kaneshiro | 439/709 |
| 2012/0190251 | A1 * | 7/2012 | Akuta | 439/722 |
| 2012/0244757 | A1 * | 9/2012 | Diessel | 439/709 |
| 2012/0319513 | A1 * | 12/2012 | Okamoto H01R | 13/5202 310/71 |
| 2014/0378003 | A1 * | 12/2014 | Wang et al. | 439/660 |

* cited by examiner

CONNECTION UNIT

BACKGROUND OF THE INVENTION

1. Field of the Invention

The invention relates to a connection unit.

2. Description of the Invention

Connection units are known which electrically connect a power unit such as a motor to a power-supply circuit which supplies electricity to the power unit. For assembling the connection unit, for example, a terminal of a cable connected to the power-supply circuit and a busbar connected to the power unit are sandwiched between a bolt and a nut and are tightened up to electrically connect the power-supply circuit and the power unit to each other.

JP2011-108411A discloses a terminal block (a connection unit) in which nuts are accommodated in nut-accommodating recesses formed in a terminal block housing, and in which busbars are attached in such a way as to cover the nuts. For mounting the busbars onto the terminal block housing, first, the nuts are accommodated into the nut-accommodating recesses, and then, each busbar is slid along its corresponding rib-shaped guide walls spaced apart from each other by a distance substantially equal to the width of the busbar, to bring the busbars into a temporally locked state. In the temporally locked state, movement of the busbar is restricted by: the guide walls of the terminal block housing; busbar pressers; and locks.

Next, round terminals connected to a refrigerator and the like are laid over the busbars, then bolts are inserted through holes formed in the round terminals and the busbars, and then are threaded into the nuts accommodated in the nut-accommodating recesses, whereby the busbars are held in a final locked state.

A mounting portion projects from a rear surface of the above-mentioned terminal block housing opposite to a front surface thereof in which the nut-accommodating recesses are formed. For installing the terminal block into a device, bolts are inserted into mounting holes formed through the mounting portion to fasten the terminal block to the device by the bolts.

For driving a power unit such as a motor, oil may be supplied to the power unit for maintaining the power unit at proper temperatures or reducing gear friction. In that case, the oil is circulated within the transmission case (the housing) that accommodates the power unit therein, and thus supplied to the power unit (by being ejected in a mist form, dripped, etc.).

For installing the terminal block of JP2011-108411A, bolts are inserted into holes formed in the transmission case while the mounting portion of the terminal block is contacted with the transmission case, followed by fastening the terminal block to the transmission case by the bolts.

In the terminal block, the guide walls and the busbar pressers for restricting movement of the busbars are formed in such a way that predetermined margins (clearances) are allowed relative to the dimensions of the busbars, which leads to a risk of leakage of the oil from the transmission case through the clearances formed between the terminal block housing and the busbars during the drive of the power unit. There has been a demand, therefore, of preventing the oil from leaking to the outside from the terminal block fitted on the housing such as the transmission case.

It is an aspect of an objective of the present invention to provide a connection unit that can accommodate nuts inside it and that also shows high sealing ability in a state installed on a housing.

SUMMARY OF THE INVENTION

In order to solve the above mentioned problem, the present invention provides a connection unit including: a terminal block formed with a nut-accommodating portion that is open at at least one side of the terminal block and that is adapted for accommodating a nut; a terminal-connecting portion that is at least partially exposed when viewed from another side and is fixed to the terminal block in such a way that a circumference of the terminal-connecting portion is in tight contact with the terminal block; and a nut cover for covering the nut accommodated in the nut-accommodating portion to prevent the nut from coming off the accommodating portion. The connection unit is fitted on a housing that houses a power unit. The connection unit is adapted to sandwich the terminal-connecting portion and an external terminal that is connected to the power unit, between a head of a bolt inserted from the other side and the nut accommodated in the nut-accommodating portion, for electrically connecting the terminal-connecting portion to the external terminal. The connection unit further includes: a first restricting means for restricting a movement of the nut cover relative to the terminal block both in an axial direction of the bolt and in a first direction perpendicular to the axial direction; and a second restricting means for restricting a movement of the nut cover relative the terminal block in a second direction perpendicular both to the axial direction and to the first direction. The second restricting means has: a locking hook formed on one of the terminal block and the nut cover; and a locking hole formed in the other one of the terminal block and the nut cover, the locking hole being adapted to receive the locking hook.

According to the above configuration, by mounting the nut cover on the nut cover, the first restricting means restricts movement of the nut cover both in the axial direction of the bolt and in the first direction perpendicular to the axial direction, and the second restricting means restricts movement of the nut cover in the second direction perpendicular both to the axial direction and to the first direction.

Accordingly, irrespective of what orientation the terminal block is installed in, removal (falling) of the nut cover is prevented and consequently, removal (falling) of the nut is prevented.

At least a part of the terminal-connecting portion is exposed when viewed from the other side. Accordingly, by mounting the nut cover in such a way as to cover the nut and then sandwiching, between the head of the bolt and the nut, the external terminal and the terminal-connecting portion over which the external terminal is laid, these components can be electrically connected.

The terminal-connecting portion is fixed in such a way that its circumference is in tight contact with the terminal block (which means that no clearance is formed between the terminal-connecting portion and the terminal block). This results in improved sealing ability of the connection unit fitted on the housing in which the power unit is housed. Accordingly, leakage of liquid such as oil supplied (by being ejected, dripped, etc.) to the power unit within the housing to the outside can be prevented.

The "circumference" refers to that of a circle in a cross sectional view of the portion, in tight contact with the terminal block, of the terminal-connecting portion, as well as the circumference of any other shape (for example, rectangle).

Preferably, the nut cover has a bolt through-hole for the bolt to penetrate through.

With this configuration, the bolt penetrates through the bolt through-hole (which means that the screw thread of the bolt protrudes past the nut cover). Even if the connection unit is installed in such a way that the second direction is a vertical direction and if the restriction by the second restricting means is released because of such factors as vibrations, the bolt prevents falling of the nut cover.

Preferably, the terminal-connecting portion comprises a plurality of terminal-connecting portions to be connected electrically to a plurality of the external terminals, and the nut-accommodating portion comprises a plurality of nut-accommodating portions, the number of which is the same as the number of the plurality of terminal-connecting portions.

With this configuration, a plurality of nuts can be held by the single nut cover, which results in a reduced number of components of the connection unit and thus simplified assembly thereof.

Preferably, the terminal block has a plurality of ribs protruding to the other side, and each of the plurality of the external terminals is arranged between the adjacent ribs.

With this configuration, the plurality of the external terminals can be easily positioned in place by the plurality of ribs when the plurality of the external terminals are assembled, enabling the adjacent external terminals to be isolated by the plurality of ribs.

Preferably, the first restricting means includes: a guide groove formed in the terminal block along the second direction; and a guide rib formed in the nut cover to mate with the guide groove.

With this configuration, the nut cover can be attached to the terminal block easily by inserting the locking hook of the terminal block (the nut cover) into the locking hole of the nut cover (the terminal block), sliding the guide rib of the nut cover along the guide groove of the terminal block. Further, even if force is exerted to move the nut cover in the axial direction and/or in the first direction, fracture of the second restricting means is suppressed and movement of the nut cover is properly restricted.

Preferably, the connection unit is fitted on the housing in such a way that the second direction is a vertical direction.

With this configuration, the terminal block is fitted on the housing that houses the power unit, in such a way that the second direction is a vertical direction. Accordingly, the first restricting means restricts movement in the horizontal direction (that is, the axial direction of the bolt and the first direction), and the second restricting means restricts movement in the vertical direction (that is, the second direction). Assembly of the connection unit can be made, therefore, in a state in which the nut reliably is held by the nut cover.

Preferably, the nut-accommodating portion is a hole open both at the one side and at the other side of the terminal block; the terminal-connecting portion is disposed at the other side of the hole; and the nut is accommodated in a recess formed by the hole and the terminal-connecting portion.

With this configuration, the terminal-connecting portion is in contact with the nut accommodated in the recess, enabling the terminal-connecting portion and the external terminal to be sandwiched between the head of the bolt and the nut to be firmly fixed to each other.

Preferably, the terminal-connecting portion is formed integrally with the terminal block by insert molding, the terminal block being made of a resin.

With this configuration where the terminal-connecting portion is formed integrally with the terminal block by insert molding, there is no clearance formed between the terminal-connecting portion and the terminal block, resulting in high sealing ability of the connection unit fitted on the housing.

The present invention can provide a connection unit that can accommodate a nut or nuts inside it and that also shows high sealing ability in a state installed on a housing.

DETAILED DESCRIPTION OF THE PREFERRED EMBODIMENTS

Now, an embodiment of the present invention will be described in detail with reference to the drawings. In the following paragraphs, an example will be described in which a connection unit S is installed on a housing H provided for a three-phase motor M (see FIG. 2A). Orientations will be described based on the front-to-rear direction, the right-to-left direction and the vertical direction as shown in FIG. 1.

Embodiment

Construction of Connection Unit

Figure 1:
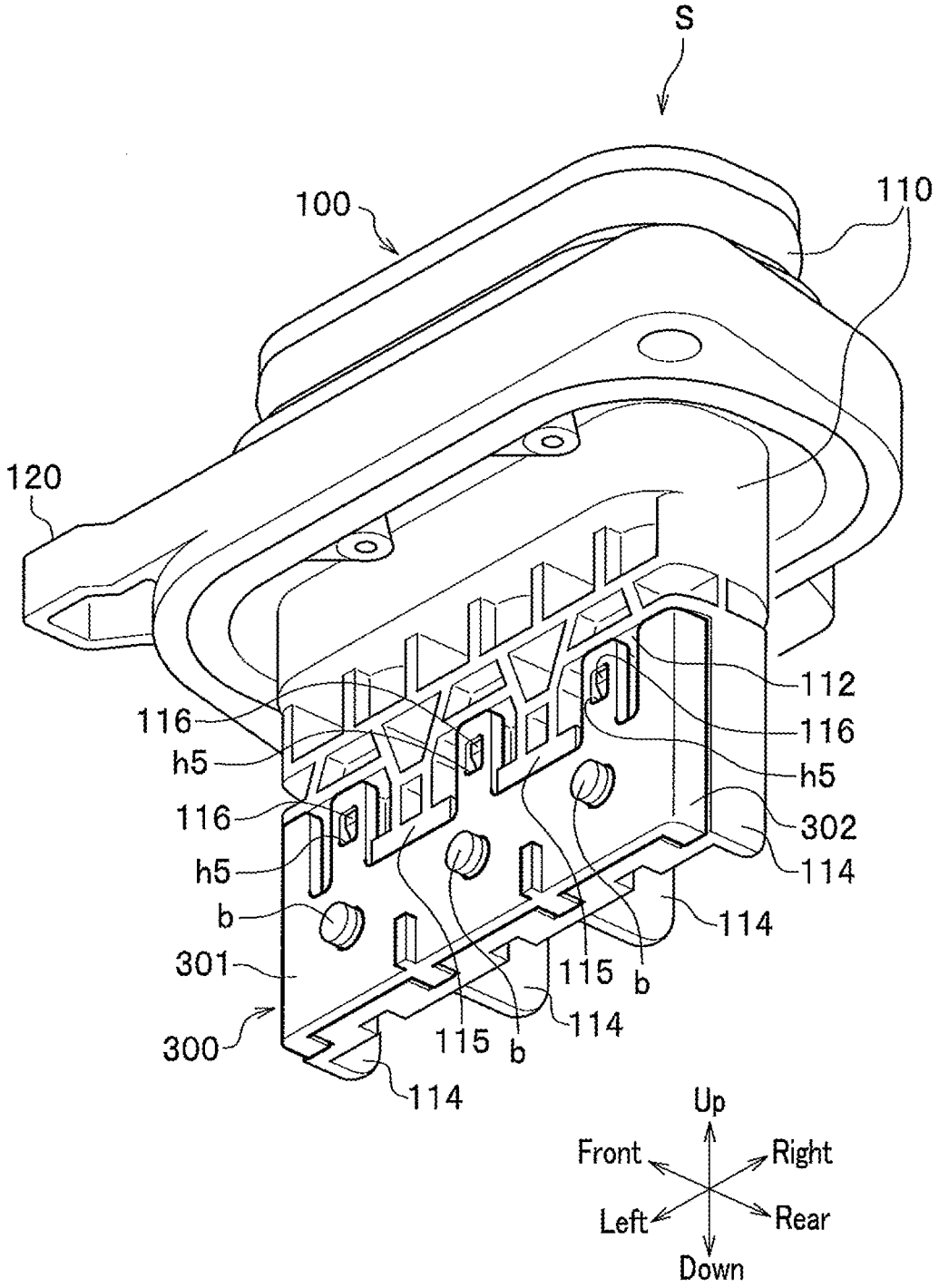
FIG. 1 is a perspective view of a connection unit according to one embodiment of the present invention viewed from a downside at right front.

A connection unit S shown in FIG. 1 is for electrically connecting a power-supply circuit such as for example an inverter (not shown) to a three-phase motor M (a power unit; see FIG. 2A) via terminal-connecting portions 200 and busbars R (external terminals). The connection unit S sandwiches the terminal-connecting portions 200 and busbars R between the heads of bolts b and nuts n accommodated in nut-accommodating holes h3 (see FIG. 3) for electrically connecting the same to each other.

Figures 2A, 2B:
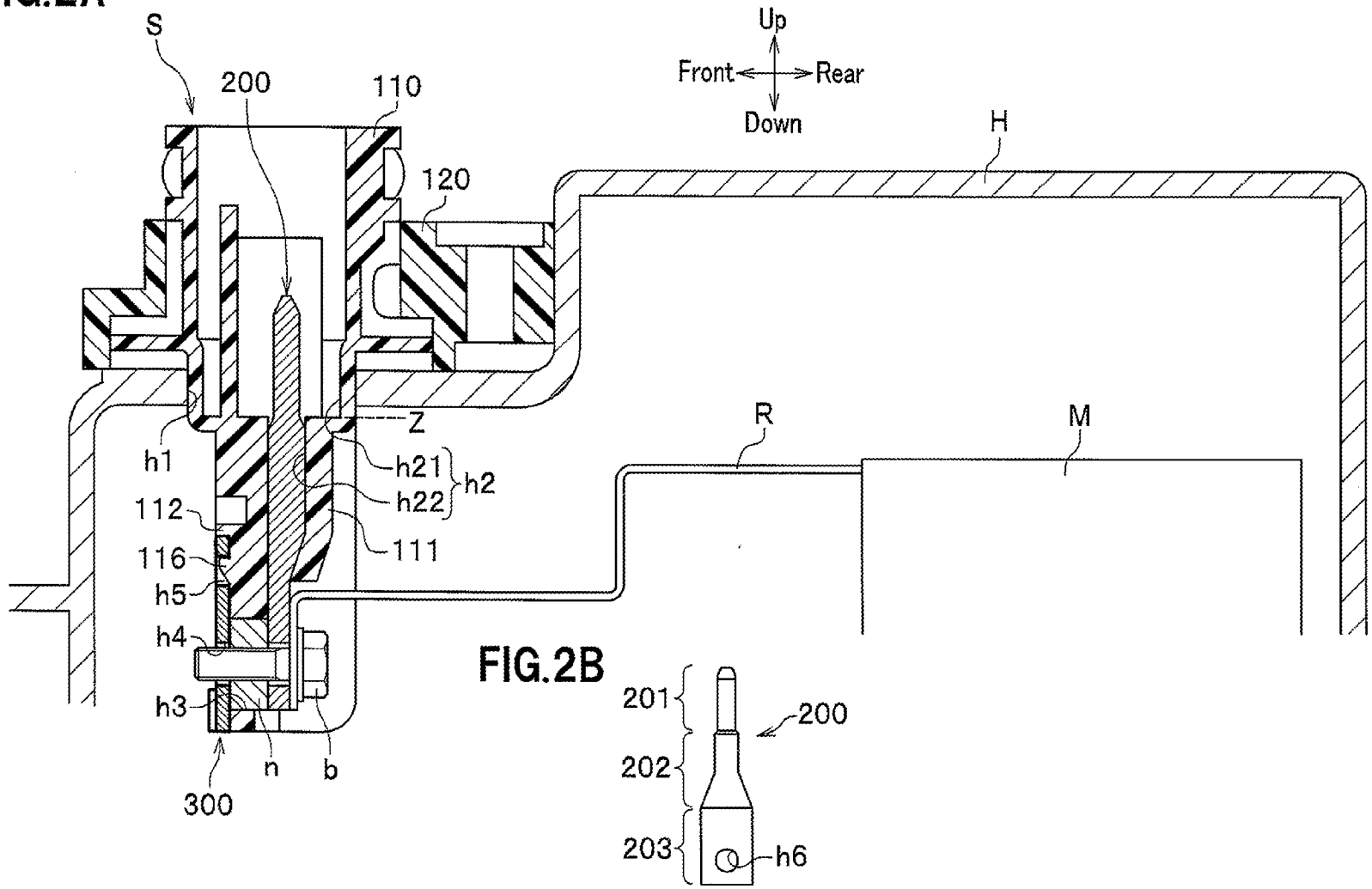
FIG. 2A is a vertical cross sectional view of the connection unit that is disposed on a motor housing.
FIG. 2B is a front view of a terminal connecting portion.

In the present embodiment, the connection unit S is inserted from above into a hole h1 formed in the housing H for the three-phase motor M in such a way that a part (a lower part) of the connection unit S faces the inside of the housing H (see FIG. 2A).

The connection unit S includes a terminal block 100 having the nut-accommodating holes h3 (see FIG. 3) formed therethrough for accommodating the nuts n, respectively; the terminal-connecting portions 200 (see FIGS. 2A and 2B) fixed on the terminal block 100; and a nut cover 300 for preventing the nuts n from coming off the nut-accommodating holes h3.

(Terminal Block)

The terminal block 100 is a resin member for holding three vertically extending terminal-connecting portions 200 (see FIGS. 2A and 2B) and accommodating three nuts n for the terminal-connecting portions 200. The three terminal-connecting portions 200 are electrically connected to three busbars R (external terminals; see FIG. 2A) in assembly of the connection unit S. In FIG. 2A, a single busbar R is shown, while in reality three busbars R are electrically connected to the terminal-connecting portions 200 and to the three-phase motor M.

The terminal block 100 includes: a holding portion 110 that has a rectangular shape when viewed from front and extends vertically; and a cylindrical abutting portion 120 that is fitted on the holding portion 110 and that abuts on the housing H (see FIG. 2A) when the connection unit S is installed on the housing H. The holding portion 110 and the abutting portion 120 are fixed to each other through fastening by bolts or the like.

Figure 7A:
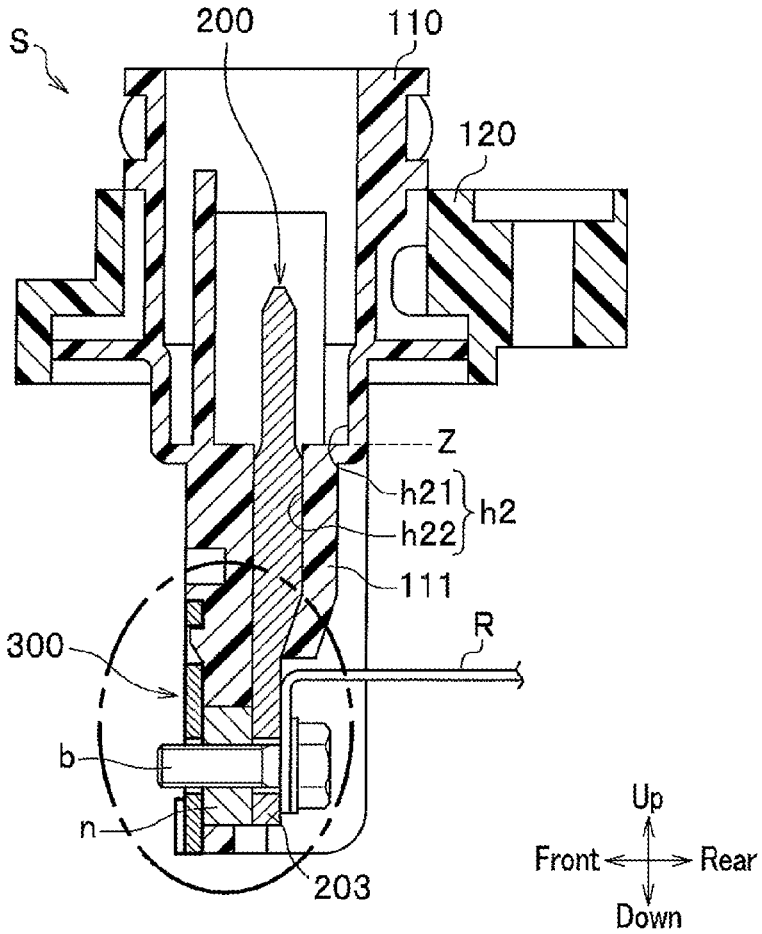
FIG. 7A is a cross sectional view of the connection unit, taken along the line B-B of FIG. 4A.

The holding portion 110 has three vertically extending holes h2 formed through inside it (see FIG. 7A). Each hole h2 has a smaller diameter at a part lower than a predetermined position Z (see FIG. 7A) in the vertical direction for restricting movement of a power-supply side terminal (not shown) which is inserted into the hole h2 from above. Of the hole h2, a part h21 (an upper part) with a larger diameter has a shape that is commensurate with the shape of the power-supply side terminal. Of the hole h2, a part h22 (a lower part) is shaped in such a way that the inner circumferential surface, of the holding portion 110, around the part h22 comes into tight contact with a fixed portion 202 of the terminal-connecting portion 200 (see FIG. 2B).

A rear wall 111 of the holding portion 110 is notched to expose thin plate portions 203 (see FIGS. 7A and 7B) of the terminal-connecting portions 200 when viewed from rear. Laying the busbars R over the exposed thin plate portions 203 and fastening by the bolts b provides electrical connection between the busbars R and the terminal-connecting portions 200.

Figure 3:
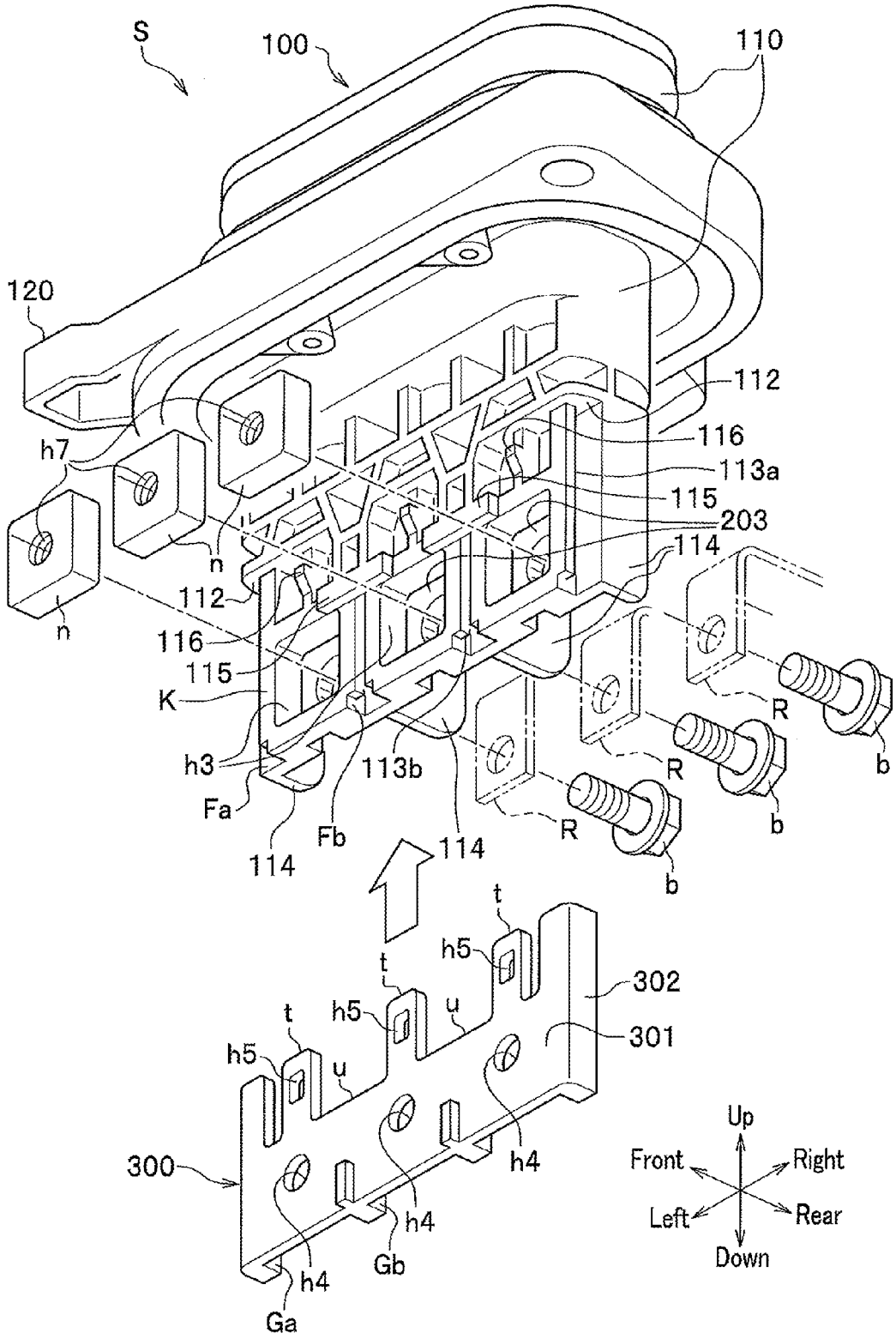
FIG. 3 is an exploded perspective view of the connection unit viewed from a downside at right front.

As shown in FIG. 3, the holding portion 110 has the nut-accommodating holes h3 (nut-accommodating portions) formed through it for accommodating the nuts n. Each nut-accommodating hole h3 extends in the front-to-rear direction (that is, is open at the opposite front and rear sides) and communicates with the part h22 having a smaller diameter of the hole h2. Thus, when the terminal-connecting portion 200 is fixed to tightly contact with the inner circumferential surface around the hole h2 (h22), the nut-accommodating hole h3 is closed with the terminal-connecting portion 200. The nuts n are accommodated into recesses each formed by: a portion, which is exposed when viewed from front, of the terminal-connecting portion 200; and the wall surfaces around the nut-accommodating hole h3.

Each nut-accommodating hole h3 is shaped to fit the nut n of a rectangular parallelopiped shape, and in a front view, has a rectangular shape. Thus, the wall surface around the nut-accommodating hole h3 acts to restrict rotation of the nut n (that is, the nut-accommodating hole h3 acts to stop the nut n from turning) when the bolt b is threaded in the nut n accommodated in the nut-accommodating hole h3.

The holding portion 110 has three projecting portions 112 that project forward and extend in the right-to-left direction. The projecting portions 112 are adapted to be abutted against respectively by protrusions t of the nut cover 300 (see FIG. 4A) when the nut cover 300 is mounted by being slid upwardly.

Figure 5:
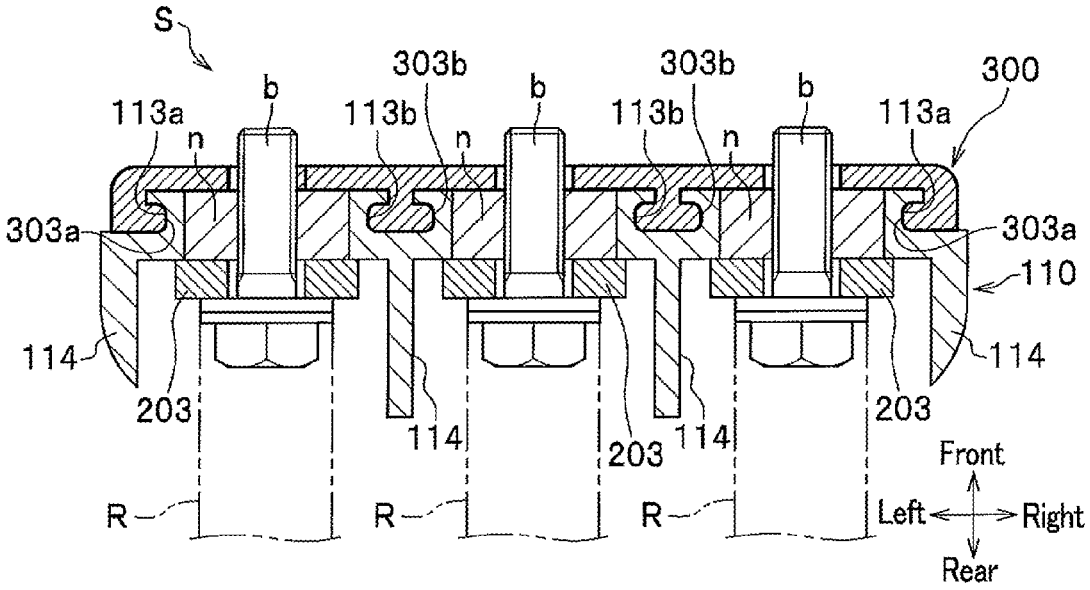
FIG. 5 is a cross sectional view of the connection unit, taken along the line A-A of FIG. 4A.

Portions of the holding portion 110 to receive sidewalls 302 of the nut cover 300 are notched inwardly in the right-to-left direction to form guide grooves 113*a* that vertically extend. The guide grooves 113*a* are shaped to engage guide ribs 303*a* of the nut cover 300 (see FIG. 5).

Figure 4A:
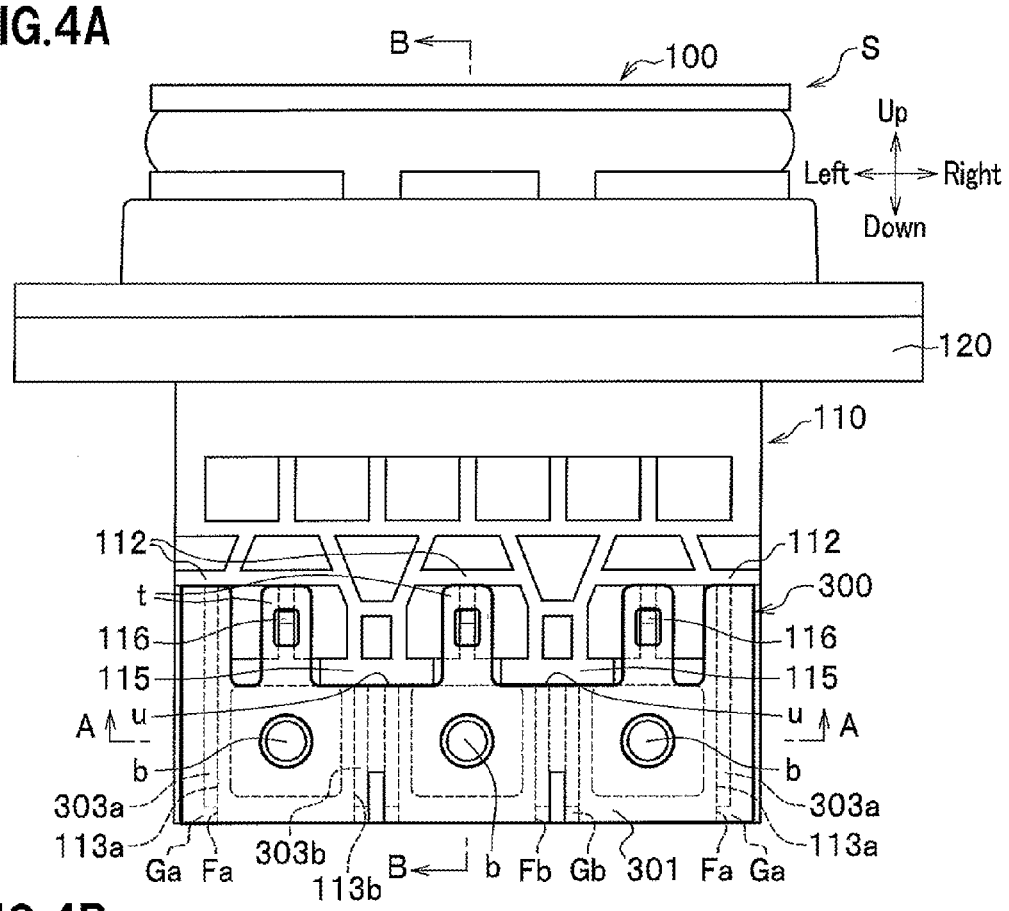
FIG. 4A is a front view of the connection unit.

Lower portions Fa of the guide grooves 113*a* are notched inwardly in the right-to-left direction to mate with lower portions Ga of the guide ribs 303*a*, respectively, of the nut cover 300 (see FIG. 4A). This configuration acts to restrict the upward movement of the guide ribs 303*a* in mounting of the nut cover 300 onto the holding portion 110.

As shown in FIG. 3, two vertically extending guide grooves 113*b* are formed between the three nut-accommodating holes h3 formed in line in the right-to-left direction. The guide grooves 113*b* are inverted T shaped in a plane cross sectional view (see FIG. 5) to engage guide ribs 303*b* of the nut cover 300 (see FIG. 6). The guide grooves 113*b* have lower ends continuous with the lower surface of the holding portion 110 (that is, open to the outside) and extend vertically as the guide ribs 303*b* do.

Lower portions Fb of the guide grooves 113*b* are notched inwardly in the right-to-left direction to mate with lower portions Gb of the guide ribs 303*b* of the nut cover 300 (see FIG. 4A). This configuration acts to restrict the upward movement of the guide ribs 303*a* in mounting of the nut cover 300 onto the holding portion 110.

As described above, the holding portion 110 (the terminal block 100) has formed therein the vertically extending guide grooves 113*a* shaped to engage the guide ribs 303*a* of the nut cover 300, as well as the vertically extending guide grooves 113*b* shaped to engage the guide ribs 303*b* thereof. This configuration acts to restrict movement of the nut cover 300 in the vertical and front-to-rear directions relative to the terminal block 100.

The "first restricting means" for restricting movement of the nut cover 300 in the front-to-rear direction (the axial direction of the bolt b) and the right-to-left direction (a first direction) relative to the terminal block 100 includes the guide grooves 113*a*, 113*b* of the terminal block 100 and the guide ribs 303*a*, 303*b* of the nut cover 300.

The holding portion 110 has thin plate-shaped ribs 114 protruding rearward at locations corresponding to the locations where the guide grooves 113*a*, 113*b* are formed. The ribs 114 extend vertically. This configuration facilitates positioning of the busbars R in mounting of the busbars R, and also insulation of the busbars R next to each other in the right-to-left direction, from each other.

In the following paragraphs, a surface of the holding portion 110 to be covered with the nut cover 300 is referred to as a "covered surface K" (see FIG. 3). The holding portion 110 has formed thereon two stopper portions 115 protruding forward from the covered surface K for restricting the sliding of the nut cover 300. The stopper portions 115 are formed on the upper side of the nut-accommodating holes h3. Each stopper portion 115 has a rectangular shape in a front view and is located with its center between the nut-accommodating holes h3, h3 in the right-to-left direction. Each stopper portion 115 has a length in the right-to-left direction equal to the width in the right-to-left direction of each of indentations u of the nut cover 300.

The holding portion 110 has locking hooks 116 projecting forward from the covered surface K and insertable into locking holes h5 of the nut cover 300. The locking hooks 116 are formed next to each other in the right-to-left direction in correspondence with the three protrusions t of the nut cover 300 and above the nut-accommodating holes h3.

Insertions of the locking hooks 116 of the holding portion 110 into the locking holes h5 of the nut cover 300 prevent vertical displacements of the nut cover 300 relative to the terminal block 100.

The "second restricting means" for restricting movement of the nut cover 300 in the vertical direction (a second direction) perpendicular both to the front-to-rear direction (the axial direction of the bolt b) and to the right-to-left direction (the first direction) relative to the terminal block 100 includes: the locking hooks 116 of the holding portion 110; and the locking holes h5 of the nut cover 300.

(Terminal-Connecting Portions)

The terminal-connecting portions 200 shown in FIGS. 2A and 2B are each an integrally formed elongate metal member composed of: a rod-like portion 201; the fixed portion 202; and the thin plate portions 203, in this order from above. As described above, the terminal-connecting portions 200 are fixed on the terminal block 100 by respectively being inserted in the three holes h2 extending vertically through the terminal block 100.

Each rod-like portion 201 is a vertically extending rod-like portion for being electrically connected to the power-supply side terminal (not shown) inserted from above. The fixed portion 202 is fixed to the terminal block 100 with the circumferential surface of the fixed portion 202 at least partially in tight contact with the inner circumferential surface around the hole h2 (h22). The thin plate portion 203 has a hole h6 through which the bolt b is penetrated and a rear surface (a back surface) exposed to the outside. In assembly of the connection unit S, the busbars R are laid over the rear surfaces (the back surfaces) of the thin plate portions 203 and are fastened by the bolts b to the thin plate portions 203, respectively.

When the nut cover 300 is not yet mounted on the terminal block 100, the front surface of the thin plate portion 203 is exposed through the nut-accommodating hole h3 (see FIG. 3).

To produce the connection unit S, the terminal-connecting portions 200 are produced beforehand and then are inserted into and fixed to a mold (not shown) complementary in shape to the holding portion 110, then, a resin is poured into a space formed between the mold and the terminal-connecting portions 200 (that is, into a space formed around the individual terminal-connecting portions 200). By performing the insert molding in this way, a holding portion 110 is formed integrally with the terminal-connecting portions 200. That is, the fixed portions 202 (see FIG. 2B) are fixed to the terminal block 100 with the circumferences of the fixed portions 202 in tight contact with the terminal block 100.

This configuration reliably prevents clearances from being formed between the holding portion 110 and the terminal-connecting portions 200, which results in improved sealing ability of the connection unit S, and consequently, reliably prevents, for example, oil supplied to maintain the three-phase motor M at proper temperatures within the housing H from leaking to the outside through the connection unit S fitted on the housing H.

The method for producing the connection unit S is not limited to the above-described insert molding. For example, the terminal-connecting portions 200 may be fitted into a holding portion 110 that has been molded beforehand, thereby to be brought into tight contact therewith. Alternatively, an adhesive may be used to bond and thereby fix the inner surfaces around the holes h2 (h22; see FIG. 2A) of the holding portion 110 to the circumferences of the terminal-connecting portions 200.

The cross section of the fixed portion 202, which comes into tight contact with the holding portion 110, of the terminal-connecting portion 200 is not limited to a circle, but may be any other shape (for example, a rectangular shape). In such a case as well, the connection unit S has high sealing ability as the circumferences of the terminal-connecting portions 200 are in tight contact with the inner surfaces around the holes h2 (h22) of the holding portion 110.

(Nut Cover)

The nut cover 300 shown in FIG. 3 is a thin-plate like resin member that covers the nuts n accommodated in the nut-accommodating holes h3, for preventing the nuts n from coming off. Three bolt through-holes h4 which the screw threads of the respective bolts b are allowed to pass through from rear are formed in line in the right-to-left direction in the nut cover 300. The bolt through-holes h4 are commensurate in size and location with holes h7 of the nuts n accommodated in the nut-accommodating holes h3. In this way, the single nut cover 300 is formed with the three bolt through-holes h4, that is, with the same number of bolt through-holes h4 as that of bolts b and that of nuts n, which can reduce the number of components of the connection unit S.

Figure 4B:
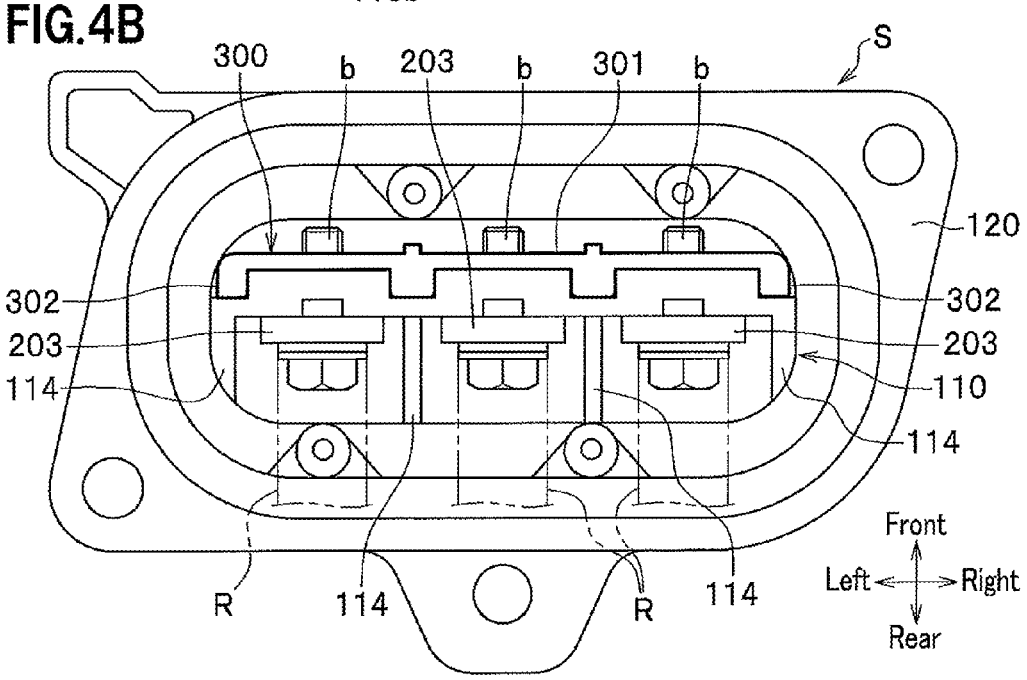
FIG. 4B is a bottom view of the connection unit.

The nut cover 300 is inverted-U shaped when viewed from below (see FIG. 4B) and includes: a flat plate-shaped covering wall 301 for covering the nuts n accommodated in the nut-accommodating holes h3; and the sidewalls 302 extending rearward from the right and left ends, respectively, of the covering wall 301. The covering wall 301 and the sidewalls 302 are formed integrally with each other. The guide ribs 303*a* project from the rear ends of the respective sidewalls 302 inwardly in the right-to-left direction (see FIGS. 5 and 6).

The guide rib 303*a* of the left sidewall 302 has an L shape in a plane cross sectional view, and the guide rib 303*a* of the right sidewall 302 has an inverted-L shape in a plane cross sectional view. As described above, the guide ribs 303*a* are shaped to engage the guide grooves 113*a* of the holding portion 110 (see FIG. 3), and the lower portions Ga of the guide ribs 303*a* project inwardly in the right-to-left direction to mate with the lower portions Fa of the guide grooves 113*a* (see FIG. 4A).

Figure 6:
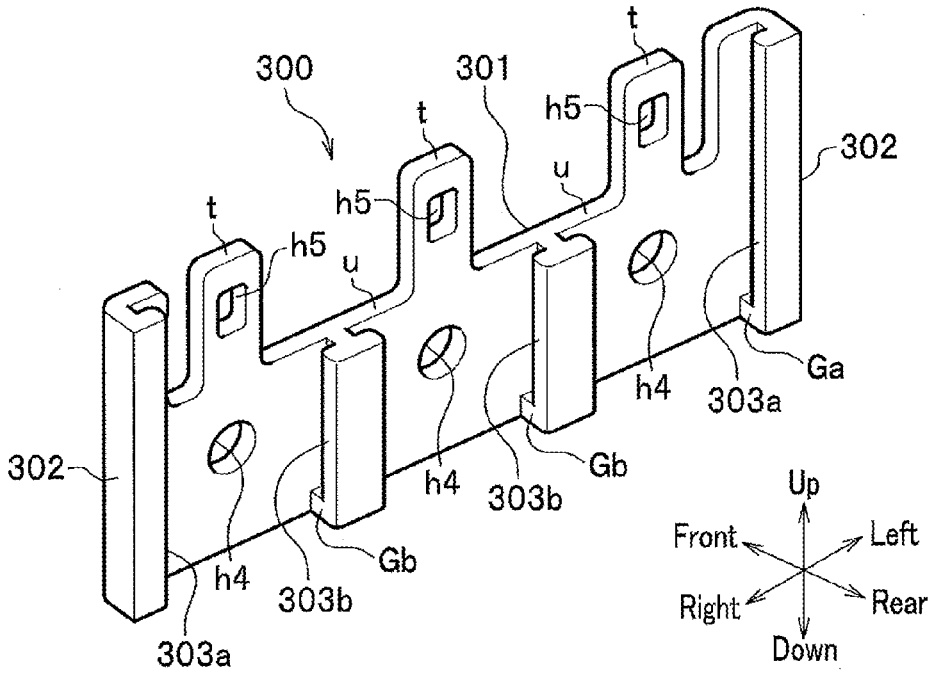
FIG. 6 is a perspective view of a nut cover viewed from a downside at left rear.

As shown in FIG. 6, the rear surface (the back surface) of the covering wall 301 has formed thereon the two guide ribs 303*b* protruding rearward and extending vertically. As described above, the guide ribs 303*b* have an inverted-T shape in a plane cross sectional view (see FIGS. 5 and 6) to engage the guide grooves 113*b* (see FIG. 3) of the holding portion 110. The lower portions Gb of the guide ribs 303*b* protrude outwardly in the right-to-left direction to mate with the lower portions Fb of the guide grooves 113*b* (see FIG. 4A).

As shown in FIG. 3, the covering wall 301 of the nut cover 300 is formed with the two indentations u that are U-shaped in a front view. In other words, the covering wall 301 of the nut cover 300 is formed with the three protrusions t extending upward from the sides of the indentations u. The protrusions t have the locking holes h5 formed through the protrusions t near the top ends thereof for allowing the locking hooks 116 of the holding portion 110 to be inserted through the locking holes h5.

<Procedure for Assembling Connection Unit>

(Accommodation of Nuts)

As shown in FIG. 3, before the nuts n are accommodated, the terminal block 100 has recesses commensurate in shape with the nuts n, each recess being formed by: the wall surface around the nut-accommodating hole h3; and the thin plate portion 203 exposed through the nut-accommodating hole h3. When the nuts n are accommodated into these holes, the front surfaces of the nuts n are approximately flush with the covered surface K, of the holding portion 110, which surrounds the nut-accommodating holes h3.

(Mounting of Nut Cover)

Next, the nut cover 300 is slid from below onto the terminal block 100. That is, the nut cover 300 is pushed upward by sliding the guide ribs 303*a* of the nut cover 300 along the guide grooves 113*a* of the holding portion 110 and by sliding the guide ribs 303*b* of the nut cover 300 along the guide grooves 113*b* of the holding portion 110.

The nut cover 300 is pushed upward until the upper ends of the protrusions t thereof come into contact with the locking hooks 116 of the terminal block 100. As the nut cover 300 is further pushed upward, the force by which the nut cover 300 is further pushed upward causes the resin protrusions t to be resiliently deformed in the forward direction to allow the locking hooks 116 of the terminal block 100 to be inserted into the locking holes h5 of the nut cover 300 (see FIG. 1).

In a state in which the locking hooks 116 are inserted in the locking holes h5, the upper ends of the protrusions t abut against the projecting portions 112 of the holding portion 110 and the wall surfaces of the indentations u abut against the stopper portions 115 of the holding portion 110, whereas the lower portions Ga of the guide ribs 303*a* abut against the lower portions Fa of the guide grooves 113*a* (see FIG. 4A) and the lower portions Gb of the guide ribs 303*b* abut against the lower portions Fb of the guide grooves 113*b*. In this way, the upward movement of the nut cover 300 is restricted. Here, the rod-like portions 201 of the terminal-connecting portions 200 are exposed to the outside in a plane view (see FIG. 7A) and the thin plate portions 203 thereof are exposed to the outside in a rear view.

(Installation of Connection Unit)

Then, the connection unit S is fitted from above into the hole h1 formed in an upper wall of the housing H (see FIG. 2A). With the connection unit S fitted on the housing H, the abutting portion 120 of the connection unit S abuts on the upper surface of the housing H, which restricts the downward movement of the connection unit S.

Further, by firmly connecting the connection unit S to the housing H through fastening by bolts or the like, the abutting portion 120 (see FIG. 2A) is tightly contacted with the upper surface of the housing H.

In this state, movement of the nut cover 300 in the front-to-rear and right-to-left directions is restricted by the guide grooves 113*a*, 113*b* of the terminal block 100 and the guide ribs 303*a*, 303*b* of the nut cover 300, and the vertical movement of the nut cover 300 is restricted by the guide grooves 113*a*, 113*b* of the terminal block 100 and the guide ribs 303*a*, 303*b* of the nut cover 300.

Accordingly, even if the connection unit S is installed in such a way that the holes h7 of the nuts n extend along the horizontal plane (that is, the covered surface K of the holding portion 110 extend along the vertical direction), movement of the nut cover 300 in the front-to-rear, right-to-left, and vertical directions is restricted, which prevents the nut cover 300 and thus the nuts n from falling by gravity.

(Connection of Busbars)

Next, as shown in FIG. 2A, the bolts b are inserted from rear, in a state in which the busbars R (the external terminals) connected to the three-phase motor M are laid over the thin plate portions 203 of the terminal-connecting portions 200. Note that holes formed through the busbars R (see FIG. 3) and the holes h6 formed through the thin plate portions 203 (see FIG. 2B) are commensurate in diameter with the screw threads of the bolts b.

As described above, the terminal-connecting portions 200 are fixed inside the holding portion 110, and movement of the nuts n in the front-to-rear, right-to-left, and vertical directions is restricted by the nut cover 300. Accordingly, the worker can lay busbars R over the thin plate portions 203 that are exposed to the outside when viewed from rear without the need to take care not to fall the nuts n.

As the bolt b is being inserted from rear, the screw thread of the bolt b penetrates through the hole of the busbar R, the hole h6 of the thin plate portion 203 (see FIGS. 2A and 2B), the hole h7 of the nut n (see FIG. 3), and the bolt through-hole h4 of the nut cover 300. In threading the bolt b, the wall surface around the nut-accommodating hole h3 acts to restrict the turning of the nut n. Thus, rotating the bolt b relative to the fixed nut n enables the bolt b to be threaded smoothly into the nut n.

When the threading is complete, the terminal-connecting portion 200 and the busbar R are in close contact with each other in the front-to-rear direction and electrically connected to each other. The screw thread of the bolt b protrudes past the nut cover 300 in a side view (see FIGS. 7A and 7B). In other words, the length of the screw thread of the bolt b is set such that the screw thread protrudes past the nut cover 300 with the head of the bolt b abutting on the busbar R.

Even if the restriction by the second restricting means (the locking hooks 116 and the locking holes h5) is released because of such factors as vibrations caused by drive of the three-phase motor M, the bolts b restricts the vertical movement of the nut cover 300. Accordingly, also in such a case, the falling of the nut cover 300 (and of the nuts n) is prevented.

(Installation of Three-Phase Motor and the Like)

Next, the three-phase motor M is installed into the housing H, and then the winding wires of the three-phase motor M are connected to the other ends of the busbars R. Further, ends of the power-supply side terminal (not shown) with other ends connected to an inverter or the like are fitted into the holes h2 that vertically extend through the holding portion 110 (see FIG. 2A). This makes the rod-like portions 201 enter the power-supply side terminals, establishing electric connections between the three-phase motor M, the busbars R, the terminal-connecting portions 200, the power-supply side terminals, and a power-supply circuit (not shown).

<Advantageous Effects>

According to the connection unit S of the present embodiment, movement of the nut cover 300 in the front-to-rear and right-to-left directions relative to the terminal block 100 is restricted by the guide grooves 113*a*, 113*b* of the terminal block 100 (see FIG. 3) and the guide ribs 303*a*, 303*b* of the nut cover 300 (see FIG. 6). Further, the vertical movement of the nut cover 300 relative to the terminal block 100 is restricted by the locking hooks 116 of the terminal block 100 (see FIG. 3) and the locking holes h5 of the nut cover 300.

As a result, by attaching the nut cover 300 after accommodating the nuts n into the nut-accommodating holes h3, the falling (removal) of the nuts n can be reliably prevented irrespective of orientation of the terminal block 100 installed, and consequently, the nuts n can be kept in place in the nut-accommodating holes h3.

Also, the fixed portions 202 of the terminal-connecting portions 200 are fixed with their circumferences in tight contact with the terminal block 100. That is, no such clearances are formed that allow communication between the inside and outside of the housing H. This configuration prevents oil supplied to the three-phase motor M contained in the housing H (see FIG. 2A), or oil in a mist form filled in the housing even to the maximum amount, from leaking to the outside through the connection unit S.

In other words, according to the present embodiment, the connection unit S has improved sealing ability and, when mounted in the housing H, improved oil-tightness (liquid-tightness).

In the invention of JP2011-108411A in which the nuts n are held by the busbars, the worker is required to mount the busbars into the terminal block housing by sliding the busbars of which ends connected to a motor and the like along the busbar pressers while taking care for the nuts not to come off the nut-accommodating recesses.

Figure 7B:
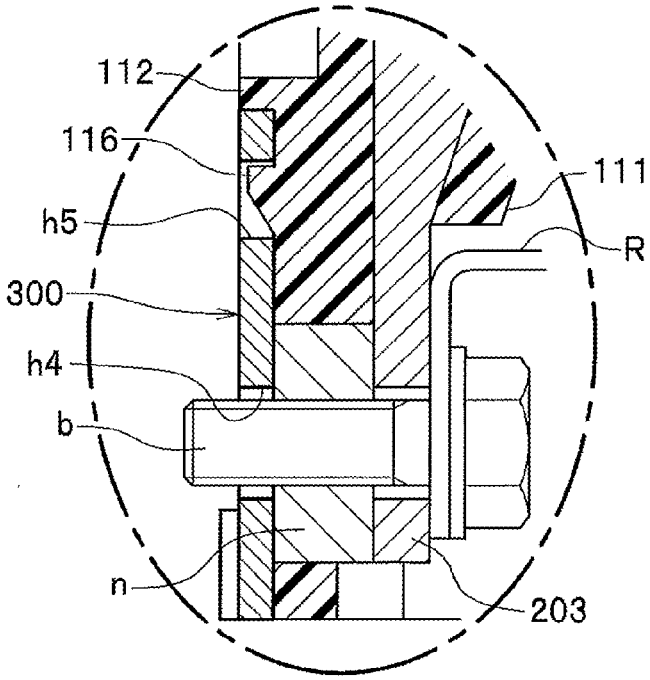
FIG. 7B is a partial enlarged view of FIG. 7A.

In contrast, in the present embodiment, the terminal-connecting portions 200 are secured to the terminal block 100, and the thin plate portions 203 are exposed in a rear view (see FIGS. 7A and 7B). Accordingly, the worker can fasten the busbars R to the terminal-connecting portions 200 by the bolts b in a state in which the nuts n are held reliably by the nut cover 300, which facilitates assembly of the connection unit S.

Also, when the bolt b is threaded in the nut n, the screw thread of the bolt b protrudes past the nut cover 300 (see FIGS. 7A and 7B). Accordingly, even if the nut cover 300 is vertically oriented and such factors as vibrations of the three-phase motor M release the restriction made by the second restricting means (the locking hooks 116, the locking holes h5), the screw threads of the bolts b prevent the falling of the nut cover 300 and, as a result, prevent malfunctioning of the three-phase motor M, allowing for continued drive thereof.

According to the present embodiment, the nuts n are held by the single nut cover 300, which results in a reduction in the number of components of the connection unit S. Further, attachment of the nut cover 300 is facilitated as the nut cover 300 can be attached by sliding the guide ribs 303*a*, 303*b* (see FIG. 6) of the nut cover 300 along the guide grooves 113*a*, 113*b* of the terminal block 100 and by fitting the locking hooks 116 into the locking holes h5.

<<Modifications>>

The connection unit S according to the present embodiment has been described hereinabove. The present invention, however, is not limited thereto, and various modifications and changes can be made.

In the above embodiment, for example, a case has been described in which the three bolt through-holes h4 are formed in the nut cover 300 (see FIG. 3) and the screw threads of the bolts b protrude past the nut cover 300 in a side view. However, the present invention is not limited to this case. That is, the nut cover 300 may have no bolt through-holes h4 and the tip ends of the screw threads of the bolts b may be located more rearward than the rear surface (the back surface) of the nut cover 300. In this case as well, the nut cover 300 prevents the coming off of the nuts n and the terminal-connecting portions 200 are fixed in such a way that the thin plate portions 203 are exposed to the outside when viewed from rear. Accordingly, the worker can easily assemble the connection unit S.

In the above embodiment, a case has been described in which the nut-accommodating holes h3 of the terminal block 100 communicate respectively with the holes h2 adapted to receive the terminal-connecting portions 200 (in other words, when no nuts n are accommodated in the nut-accommodating holes h3, the terminal-connecting portions 200 are exposed through the nut-accommodating holes h3 to the outside in a front view; see FIG. 3). The invention, however, is not limited to this case. That is, in place of the nut-accommodating holes h3, bottomed holes that are U-shaped in a side view (nut-accommodating portions) and forwardly opened may be formed. In such a case, the bottom wall in each U-shaped bottomed hole partitions the nut n and the terminal-connecting portion 200.

Further, in the above embodiment, a case has been described in which the locking hooks 116 are located above the nut-accommodating holes h3. The invention, however, is not limited to this case. That is, one or more locking hooks may be formed in predetermined locations on the holding portion 110 and locking holes may be formed in corresponding locations through the nut cover 300.

Moreover, in the above embodiment, a case has been described in which the terminal block 100 has the locking hooks 116 and the nut cover 300 has the locking holes h5. The invention, however, is not limited to this case. That is, the terminal block 100 may have locking holes and the nut cover 300 may have locking hooks. In this case as well, movement in the vertical direction (the second direction) of the nut cover 300 can be restricted by the locking holes and locking hooks (the second restricting means).

Also, in the above embodiment, a case has been described in which the single nut cover 300 covers the nuts n accommodated in the nut-accommodating holes h3. The invention, however, is not limited to this case. That is, three nut covers corresponding to the nut-accommodating holes h3, respectively, may prevent the nuts n from coming off.

Further, in the above embodiment, a case has been described in which the "external terminals" to be connected to the thin plate portions 203 of the terminal-connecting portions 200 are the busbars R. The invention, however, is not limited to this case. For example, the "external terminals" may be crimp terminals such as ring terminals or spade terminals.

Also, in the above embodiment, a case has been described in which the "first restricting means" for restricting movement of the nut cover 300 in the front-to-rear direction (the axial direction of the bolt b) and the right-to-left direction (the first direction) comprises the guide grooves 113*a*, 113*b* of the terminal block 100 and the guide ribs 303*a*, 303*b* of the nut cover 300. The invention, however, is not limited to this case. For example, the nut cover 300 may have locks (first restricting means) projecting inwardly in the right-to-left direction from the sidewalls 302, and the terminal block 100 may have locking holes (first restricting means) each as a recess depressed inwardly in the right-to-left direction to mate with the locks.

In such a case, the nut cover 300 as a resin member is resiliently deformed to allow the locks to fit into the locking holes, whereby the nut cover 300 is attached to the terminal block 100. In this way, movement of the nut cover 300 in the front-to-rear and right-to-left directions can be restricted.

Further, locking holes may be formed through the right and left walls of the nut cover 300 (the first and the second restricting means). In such a case, locking hooks (the first and the second restricting means) to mate with the locking holes are formed on the terminal block 100, then, the nut cover 300 is mounted from front onto the terminal block 100, and the locking hooks are fitted into the locking holes. In this way, movement of the nut cover 300 in the front-to-rear, right-to-left and vertical directions can be restricted.

Moreover, a plurality of vertically extending slits (the first restricting means) may be formed in the nut cover 300, and a plurality of ribs (the first restricting means) to mate therewith may be formed to protrude forward from the covered surface K (see FIG. 1) of the terminal block 100. In such a case, the ribs are slid up in the slits to mount the nut cover 300.

Further, in the above embodiment, a case has been described in which the connection unit S is installed on the housing H in such a way that the nut cover 300 is in a vertical plane. The invention, however, is not limited to this case. That is, the connection unit S may be installed in such a way that the nut cover 300 is in any other predetermined plane than the vertical plane.

Moreover, in the above embodiment, a case has been described in which the "power unit" to be connected to the busbars R is the three-phase motor M. The invention, however, is not limited to this case. That is, the connection unit S can be installed for various electric appliances other than the three-phase motor.

The invention claimed is:

1. A connection unit comprising:

a terminal block comprising a nut-accommodating portion adapted for accommodating a nut, the nut-accommodating portion located on one side of the terminal block in which an opening is formed in an axial direction of the nut, and a holding portion that has a hole formed through the holding portion;

a terminal-connecting portion that is partially exposed when viewed from the other side of the terminal block and is fixed to the holding portion in such a way that a part of an outer surface of the terminal-connecting portion is in tight contact with an inner surface of the hole of the holding portion; and a nut cover for covering a top surface of the nut accommodated in the nut-accommodating portion to prevent the nut from coming off the accommodating portion, the connection unit being fitted on a housing that houses a power unit, the connection unit being adapted to sandwich the terminal-connecting portion and an external terminal that is connected to the power unit, between a head of a bolt inserted from the other side and the nut accommodated in the nut-accommodating portion, for electrically connecting the terminal-connecting portion to the external terminal, the connection unit further comprising:

a first restricting means for restricting a movement of the nut cover relative to the terminal block both in an axial direction of the bolt and in a first direction perpendicular to the axial direction; and a second restricting means for restricting a movement of the nut cover relative the terminal block in a second direction perpendicular both to the axial direction and to the first direction, the second restricting means comprising:

a locking hook formed on one of the terminal block and the nut cover; and a locking hole formed in the other one of the terminal block and the nut cover, the locking hole being adapted to receive the locking hook, wherein the nut cover disposed at the one side of the terminal block in the axial direction of the nut has a bolt through-hole for the bolt to penetrate such that a tip end of a screw thread of the bolt protrudes from the nut cover with the nut being thread-engaged with the bolt.

2. The connection unit of claim 1, wherein the terminal-connecting portion comprises a plurality of terminal-connecting portions to be connected electrically to a plurality of the external terminals; and the nut-accommodating portion comprises a plurality of nut-accommodating portions, the number of which is the same as the number of the plurality of terminal-connecting portions.

3. The connection unit of claim 2, wherein the terminal block has a plurality of ribs protruding to the other side, and each of the plurality of the external terminals is arranged between the adjacent ribs.

4. The connection unit of claim 1, wherein the first restricting means includes: a guide groove formed in the terminal block along the second direction; and a guide rib formed in the nut cover to mate with the guide groove.

5. The connection unit of claim 1, which is fitted on the housing in such a way that the second direction is a vertical direction.

6. The connection unit of claim 1, wherein the nut-accommodating portion is a hole open both at the one side and at the other side of the terminal block;

the terminal-connecting portion is disposed at the other side of the hole; and the nut is accommodated in a recess formed by the hole and the terminal-connecting portion.

7. The connection unit of claim 1, wherein the terminal-connecting portion is formed integrally with the terminal block by insert molding, the terminal block being made of a resin.

* * * * *